US010345749B2

(12) United States Patent
Yamada

(10) Patent No.: US 10,345,749 B2
(45) Date of Patent: Jul. 9, 2019

(54) IMAGE FORMATION APPARATUS AND NON-TRANSITORY COMPUTER READABLE RECORDING MEDIUM

(71) Applicant: Konica Minolta Inc., Tokyo (JP)

(72) Inventor: Tatsutoshi Yamada, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/171,832

(22) Filed: Oct. 26, 2018

(65) Prior Publication Data

US 2019/0155200 A1 May 23, 2019

(30) Foreign Application Priority Data

Nov. 17, 2017 (JP) ..... 2017-222045

(51) Int. Cl.
*G03G 15/00* (2006.01)
*G03G 15/04* (2006.01)
*G03G 15/043* (2006.01)

(52) U.S. Cl.
CPC ..... *G03G 15/5029* (2013.01); *G03G 15/0435* (2013.01); *G03G 15/04072* (2013.01); *G03G 2215/00616* (2013.01); *G03G 2215/00751* (2013.01)

(58) Field of Classification Search
CPC ..... G03G 15/5029; G03G 15/04072; G03G 15/0435; G03G 2215/00616; G03G 2215/00751
See application file for complete search history.

(56) References Cited

U.S. PATENT DOCUMENTS

2011/0182600 A1* 7/2011 Mizuno ..... G03G 15/0131 399/39
2017/0031265 A1* 2/2017 Tajima ..... G03G 15/0184
2017/0336732 A1* 11/2017 Mizuno ..... G03G 15/0435

FOREIGN PATENT DOCUMENTS

JP 2002202691 A 7/2002

* cited by examiner

*Primary Examiner* — Gregory H Curran
(74) *Attorney, Agent, or Firm* — Lucas & Mercanti, LLP

(57) ABSTRACT

An image formation apparatus includes: a light source configured to emit laser light; a polygon mirror configured to reflect the laser light; a photoreceptor configured to be exposed to the laser light reflected by the polygon mirror; a motor configured to rotate the polygon mirror; and a controller configured to sense a type of a sheet transported through the image formation apparatus. The image formation apparatus includes as operation modes a first mode in which no sheet type is sensed and a second mode in which a sheet type is sensed. The controller performs different processes for control regarding rotation of the motor in the first and second modes, respectively.

16 Claims, 18 Drawing Sheets

BEFORE SHEET TYPE IS SENSED

AFTER SHEET TYPE IS SENSED

FIG.7

D2

| | PLAIN SHEET | THICK SHEET 1 | THICK SHEET 2 |
|---|---|---|---|
| BASIS WEIGHT(g/m^2) | 60～90 | 91～157 | 158～300 |
| SYSTEM RATE(mm/s) | 325 | 162.5 | 108.3 |
| RESOLUTION(dpi) | 600 | 600 | 600 |
| NO. OF MIRROR PLANES | 7 | 7 | 7 |
| NO. OF BEAMS | 2 | 2 | 2 |
| EXPOSURE ROTATION SPEED(rpm) | 33000 | 16000 | 11000 |

FIG.8A

D1

| SHEET TYPE | EXPOSURE ROTATION SPEED(rpm) | HOW FREQUENTLY EXPOSURE ROTATION SPEEDS ARE EFFECTED (TIMES) |
|---|---|---|
| PLAIN SHEET | 33000 | 300 |
| THICK SHEET 1 | 16000 | 50 |
| THICK SHEET 2 | 11000 | 100 |

FIG.8B

D1

| SHEET TYPE | EXPOSURE ROTATION SPEED(rpm) | HOW FREQUENTLY EXPOSURE ROTATION SPEEDS ARE EFFECTED (TIMES) |
|---|---|---|
| PLAIN SHEET | 33000 | 600 |
| THICK SHEET 1 | 16000 | 200 |
| THICK SHEET 2 | 11000 | 250 |

FIG.8C

D1

| SHEET TYPE | EXPOSURE ROTATION SPEED(rpm) | HOW FREQUENTLY EXPOSURE ROTATION SPEEDS ARE EFFECTED (TIMES) |
|---|---|---|
| PLAIN SHEET | 33000 | 700 |
| THICK SHEET 1 | 16000 | 600 |
| THICK SHEET 2 | 11000 | 200 |

BEFORE EXPOSURE IS STARTED (IN 1ST MODE)

AFTER EXPOSURE IS STARTED (IN 1ST MODE)

BEFORE SHEET TYPE IS SENSED (IN 2ND MODE)

AFTER SHEET TYPE IS SENSED (IN 2ND MODE)

IMAGE FORMATION APPARATUS AND NON-TRANSITORY COMPUTER READABLE RECORDING MEDIUM

The entire disclosure of Japanese Patent Application No. 2017-222045, filed on Nov. 17, 2017, is incorporated herein by reference in its entirety.

BACKGROUND

Technological Field

The present disclosure relates to an image formation apparatus, and more particularly, to controlling a polygon motor of the image formation apparatus.

Description of the Related Art

MFP (Multi Functional Peripheral) and other image formation apparatuses have been widely used. An electrophotographic image formation apparatus performs a printing process including electrically charging a photoreceptor, exposing the photoreceptor to light according to an input image pattern, and causing toner to adhere to an electrostatic latent image formed by the exposure.

In order to expose the photoreceptor to light, a polygon mirror that reflects laser light emitted front a light source is rotated at high speed in the image formation apparatus. The polygon mirror's rotation speed is determined depending on the type of a sheet on which an image is to be formed.

As a technique used to control rotation of a polygon motor, for example, Japanese Laid-Open Patent Publication No. 2002-202691 discloses an image formation apparatus in which a polygon motor's rotation speed is determined depending on the thickness of a transferring sheet as sensed by a sheet thickness sensor.

However, with the above-described conventional technique, after the type of a sheet is sensed the polygon motor's rotation speed is determined, and accordingly, the polygon motor's rotation is controlled. This, however, introduces an unnecessary standby time when it is unnecessary to sense a sheet. Therefore, there is a demand for more appropriately controlling the polygon motor in accordance with whether a sheet sensing process is done or not.

SUMMARY

To achieve at least one of the abovementioned objects, according to an aspect of the present invention, an image formation apparatus reflecting one aspect of the present invention comprises: a light source configured to emit laser light; a polygon mirror configured to reflect the laser light; a photoreceptor configured to be exposed to the laser light reflected by the polygon mirror; a motor configured to rotate the polygon mirror; and a controller configured to sense a type of a sheet transported through the image formation apparatus.

The image formation apparatus includes as operation modes a first mode in which no sheet type is sensed and a second mode in which a sheet type is sensed. The controller performs different processes for control regarding rotation of the motor in the first and second modes, respectively.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 7 is a diagram showing an example of a sheet type classification table.

FIGS. 8A to 8C show examples of a rotation speed history table.

DETAILED DESCRIPTION OF EMBODIMENTS

Hereinafter, one or more embodiments of the present invention will be described with reference to the drawings. However, the scope of the invention is not limited to the disclosed embodiments. In the following description, identical parts and components are identically denoted. Their names and functions are also identical. Accordingly, they will not be described redundantly in detail. Note that each embodiment and each modification described below may be selectively combined as appropriate.

First Embodiment

[1. Image Formation Apparatus 100]

Figure 1:
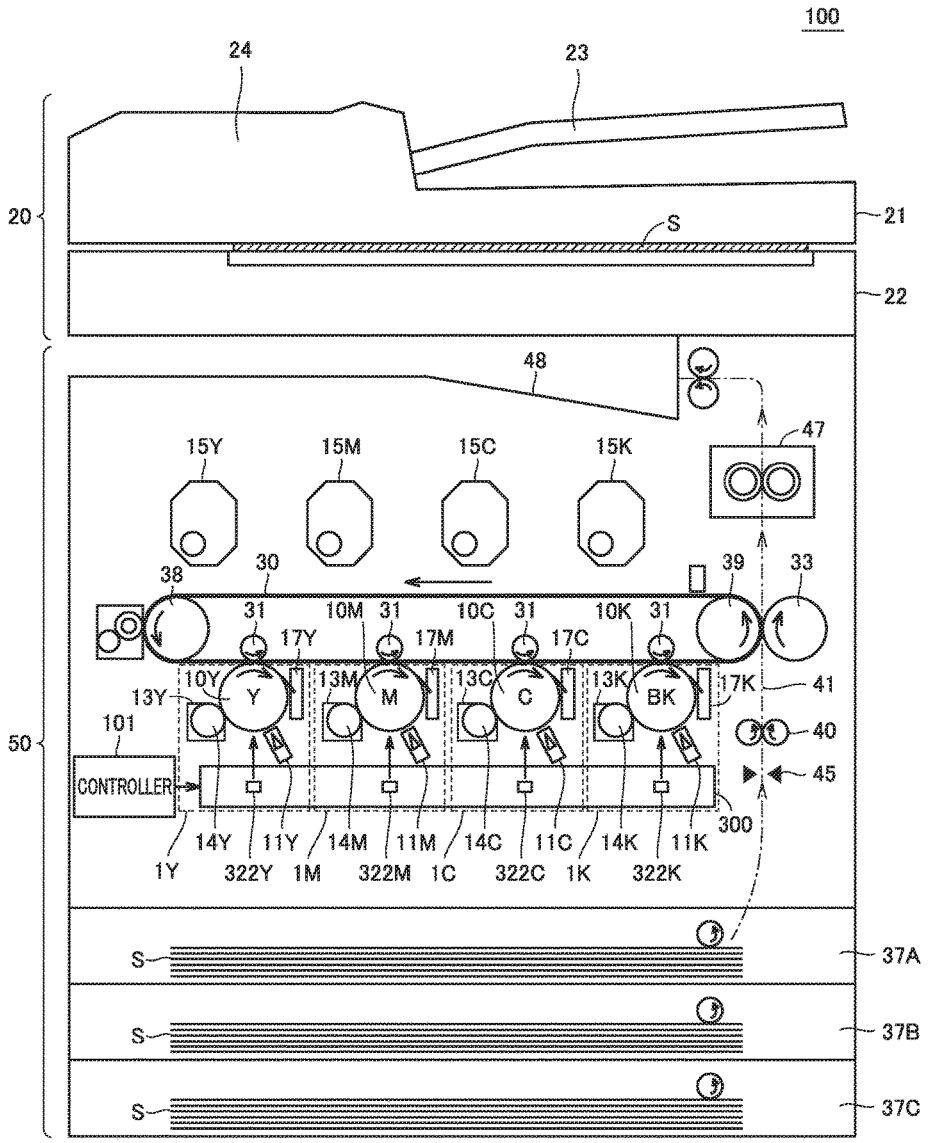
FIG. 1 is a diagram showing an example of a configuration of an image formation apparatus.

With reference to FIG. 1, an image formation apparatus 100 according to a first embodiment will be described. FIG. 1 is a diagram showing an example of a configuration of image formation apparatus 100.

Image formation apparatus 100 as a color printer is shown in FIG. 1. Hereinafter, while image formation apparatus 100 as a color printer will be described, image formation apparatus 100 is not limited to the color printer. For example, image formation apparatus 100 may be a monochrome printer, or a multi-functional peripheral (MFP) of a monochrome printer, a color printer and a fax.

Image formation apparatus 100 includes a scanner 20 and a printer 50. Scanner 20 includes a cover 21, a platen 22, a tray 23, an ADF (auto document feeder) 24. Cover 21 has one end fixed to platen 22, and cover 21 can be opened and closed with the one end serving as a fulcrum. A user of image formation apparatus 100 can open cover 21 to set a sheet on platen 22. When a sheet is set on platen 22 and in that condition image formation apparatus 100 receives an instruction to scan the sheet image formation apparatus 100 starts to scan the sheet set on platen 22. Further, when sheets are set on tray 23 and in that condition image formation apparatus 100 receives an instruction to scan the sheets ADF 24 automatically reads the sheets one by one.

Printer 50 includes image forming units 1Y, 1M, 1C and 1K, an intermediate transfer belt 30, a primary transfer roller 31, a secondary transfer roller 33, cassettes 37A to 37C, a driven roller 38, a driving roller 39, a registration roller 40, a fixing device 47, and a controller 101.

Image forming units 1Y, 1M, 1C, and 1K are aligned sequentially along intermediate transfer belt 30. Image forming unit 1Y receives toner supplied from a toner bottle 15Y to form a toner image of yellow (Y). Image forming unit 1M receives toner supplied from a toner bottle 15M to form a toner image of magenta (M). Image forming unit 1C receives toner supplied from a toner bottle 15C to form a toner image of cyan (C). Image forming unit 1K receives toner supplied from a toner bottle 15K to form a toner image of black (BK).

Image forming unit 1Y includes a photoreceptor 10Y, a charging device 11Y, a light source 322Y, a developing device 13Y, and a cleaning device 17Y. Image forming unit 1M includes a photoreceptor 10M, a charging device 11M, a light source 322M, a developing device 13M, and a cleaning device 17M. Image forming unit 1C includes a photoreceptor 10C, a charging device 11C, a light source 322C, a developing device 13C, and a cleaning device 17C. Image forming unit 1K includes a photoreceptor 10K, a charging device 11K, a light source 322K, a developing device 13K, and a cleaning device 17K.

In the following description, photoreceptors 10Y, 10M, 10C, and 10K will also collectively be referred to as a photoreceptor 10. Charging devices 11Y, 11M, 11C, 11K will also collectively be referred to as a charging device 11. Light sources 322Y, 322M, 322C, and 322K will also collectively be referred to as a light source 322. Developing devices 13Y, 13M, 13C, and 13K will also collectively be referred to as a developing device 13. Cleaning devices 17Y, 17M, 17C and 17K will also collectively be referred to as a cleaning device 17.

Charging device 11 charges a surface of photoreceptor 10 uniformly. Light source 322 operates in response to a control signal received from controller 101 to irradiate photoreceptor 10 with laser light to expose a surface of photoreceptor 10 to light according to an input image pattern. Thus, an electrostatic latent image corresponding to an input image is formed on photoreceptor 10. Light source 322 is provided in a print head 350. Print head 350 will more specifically be described hereinafter.

Developing device 13, while rotating a developing roller 14, applies a developing bias to developing roller 14 and thus causes toner to adhere to a surface of developing roller 14. Thus, the toner is transferred from developing roller 14 to photoreceptor 10, and a toner image corresponding to an electrostatic latent image formed on photoreceptor 10 is developed on a surface of photoreceptor 10.

Photoreceptor 10 and intermediate transfer belt 30 are in contact with each other at a portion at which primarily transfer roller 31 is provided. A transferring voltage opposite in polarity to the toner image is applied to primarily transfer roller 31 to transfer the toner image from photoreceptor 10 to intermediate transfer belt 30. A toner image of yellow (Y), a toner image of magenta (M), a toner image of cyan (C), and a toner image of black (BK) are superposed, one on another, sequentially and thus transferred from photoreceptor 10 to intermediate transfer belt 30. Thus, a color toner image is formed on intermediate transfer belt 30.

Intermediate transfer belt 30 is tensioned and thus engaged on driven roller 38 and driving roller 39. Driving roller 39 is rotatably driven by a motor (not shown). Intermediate transfer belt 30 and driven roller 38 are ganged with driving roller 39 and thus rotated. Thus, the toner image on intermediate transfer belt 30 is transported to a transferring area of secondary transfer roller 33.

Cleaning device 17 is pressed into contact with photoreceptor 10. Cleaning device 17 collects toner which remains on a surface of photoreceptor 10 after a toner image is transferred.

Different sizes or types of sheets are set in cassettes 37A to 37C, respectively. Hereinafter, cassettes 37A to 37C will also collectively be referred to as a cassette 37. A sheet transported from cassette 37 to a transporting path 41 is sent to secondary transfer roller 33 by registration roller 40.

A sheet sensor 45 is disposed in front of registration roller 40. Sheet sensor 45 is composed of a reflective photosensor and a transmissive photosensor, and senses the basis weight of a sheet transported through transporting path 41.

Sheet sensor 45 is disposed so as to sense the basis weight of a sheet transported between cassette 37 and registration roller 40. When this is compared with providing a plurality of sheet sensors 45 each in cassette 37, the former can not only reduce sheet sensor 45 in number and hence cost but also reduce a period of time required to keep a subsequent process waiting after a sheet type is sensed.

Secondary transfer roller 33 applies a transferring voltage opposite in polarity to the toner image to a sheet being transported. Thus, the toner image is attracted from intermediate transfer belt 30 to secondary transfer roller 33, and the toner image on intermediate transfer belt 30 is thus transferred. Timing to transport the sheet to secondary transfer roller 33 is adjusted by registration roller 40 in accordance with the position of the toner image on intermediate transfer belt 30. By registration roller 40, the toner image on intermediate transfer belt 30 is transferred to an appropriate position on the sheet.

Fixing device 47 applies pressure to and heat a sheet passing therethrough. Thus, the toner image is fixed to the sheet. Subsequently, the sheet is discharged to a tray 48.

[2. Print Head 350]

Figure 2:
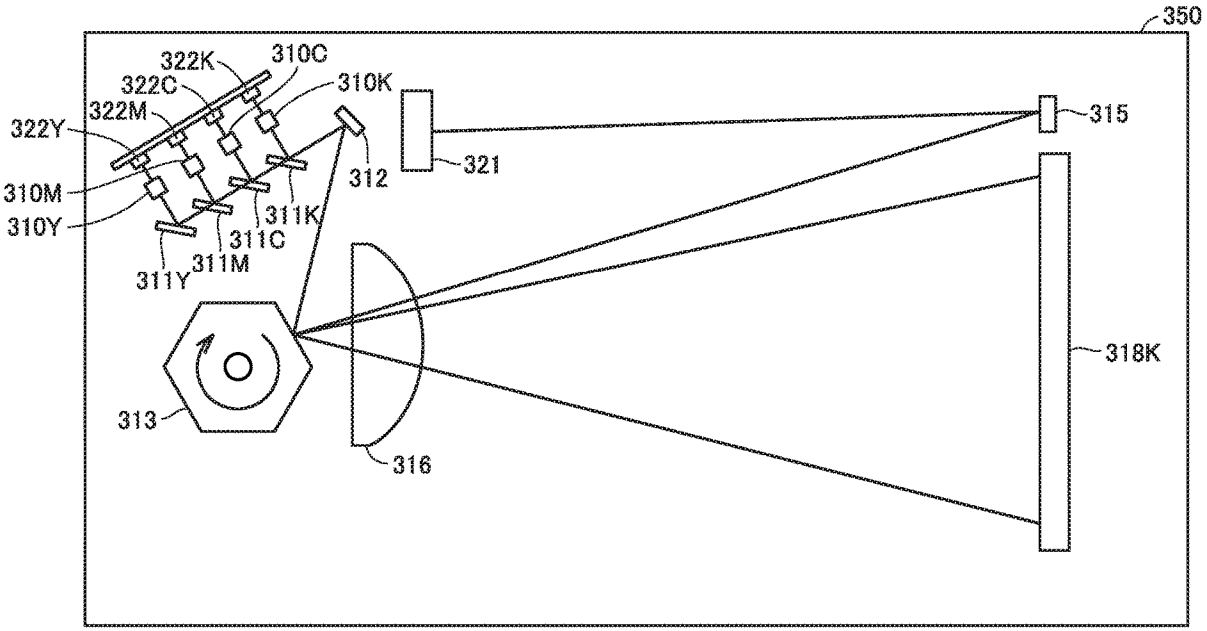
FIG. 2 is a plan view of an internal structure of a print head.
Figure 3:
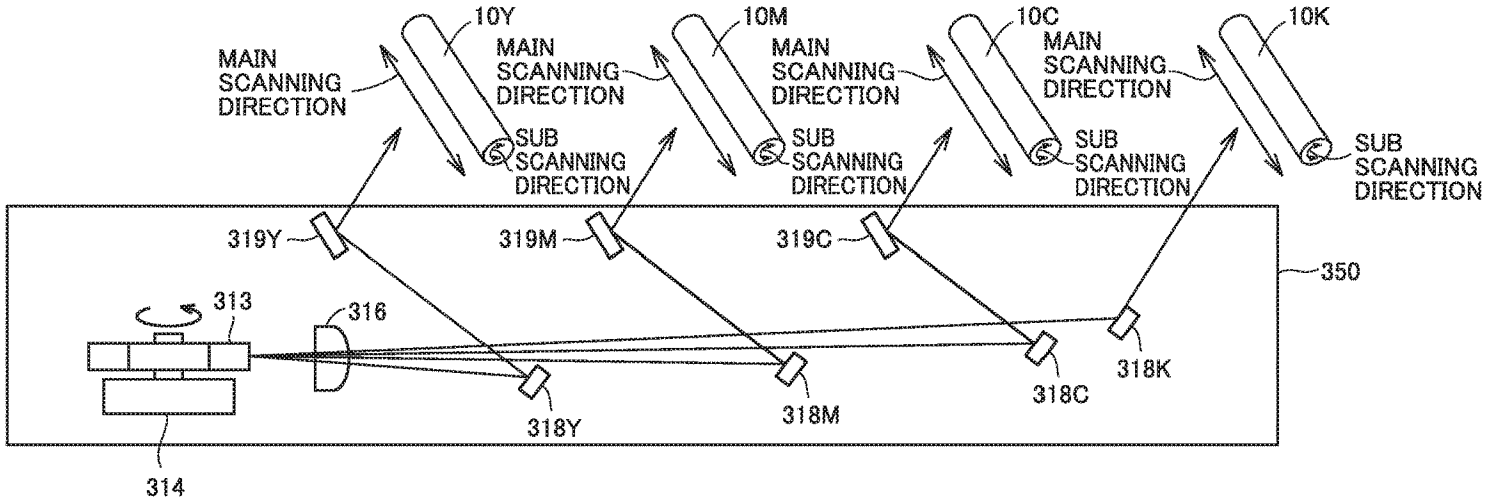
FIG. 3 is a schematic diagram showing a relationship between the print head and a photoreceptor.

With reference to FIGS. 2 and 3, an internal structure of print head 350 will be described. FIG. 2 is a plan view of the internal structure of print head 350. FIG. 3 is a schematic diagram showing a relationship between print head 350 and photoreceptor 10.

As shown in FIG. 2, print head 350 includes light sources 322Y, 322M, 322C, 322K, collimator lenses 310Y, 310M, 310C, 310K, mirrors 311Y, 311M, 311C, 311K, a mirror 312, a polygon mirror 313, a polygon motor 314, an fθ lens 316, mirrors 318Y, 318M, 318C, 318K, mirrors 319Y, 319M, 319C, a mirror 315, and a light sensor 321.

In the following, an optical path of laser light emitted from light source 322 will be described. The laser light emitted from light source 322K is collimated by collimator lens 310K and irradiates mirror 311K. Mirror 311K reflects the laser light that has passed through collimator lens 310K to mirror 312. Mirror 312 reflects the laser light to polygon mirror 313.

Polygon mirror 313 as a rotary polygon mirror has a prismatic shape (for example, a hexagonal prism). Polygon mirror 313 has a side surface composed of mirror. Polygon mirror 313 is rotatably driven by polygon motor 314. Polygon mirror 313 reflects the laser light while rotating to regularly change a direction in which the laser light is reflected. Polygon mirror 313 reflects the laser light to fθ lens 316 while rotating. The laser light that has passed through fθ lens 316 is reflected by mirror 318 to photoreceptor 10K (see FIG. 1).

As shown in FIG. 3, by rotating photoreceptor 10K while rotating polygon mirror 313, image formation apparatus 100 scans photoreceptor 10K with the laser light reflected by polygon mirror 313. In doing so, one plane of mirror of polygon mirror 313 is used to scan one line of photoreceptor 10K in a main scanning direction. The main scanning direction indicates a direction of an axis of rotation of photoreceptor 10. When polygon mirror 313 is composed of six planes of mirror, and polygon mirror 313 rotates once, six lines of photoreceptor 10K in the main scanning direction are scanned. Image formation apparatus 100 switches on/off light source 322K in accordance with an input image pattern to expose any location on photoreceptor 10K. As a result, an electrostatic latent image representing an input image is formed on photoreceptor 10K.

Similarly, laser light emitted from light source 322Y is reflected by polygon mirror 313 onto photoreceptor 10Y. Laser light emitted from light source 322M is reflected by polygon mirror 313 onto photoreceptor 10M. The laser beam emitted from light source 322C is reflected by polygon mirror 313 onto photoreceptor 10C. By installing mirrors 311Y, 311M, 311C, 311K stepwise, laser lights emitted from light sources 322Y, 322M, 322C, 322K are reflected to photoreceptors 10Y, 10M, 10C, 10K, respectively.

Photoreceptors 10Y, 10M, 10C, and 10K each have a cylindrical shape and are each configured to be rotatable in its circumferential direction. Herein, as shown in FIG. 3, a lengthwise direction of the cylindrical shape is defined as the main scanning direction, and the circumferential direction is defined as a sub-scanning direction. The sub-scanning direction corresponds to a sheet transporting direction. When enlarging or reducing a magnification of an image to be formed on a sheet, image formation apparatus 100 sets a magnification in the sub-scanning direction.

[3. Hardware Configuration]

Figure 4:
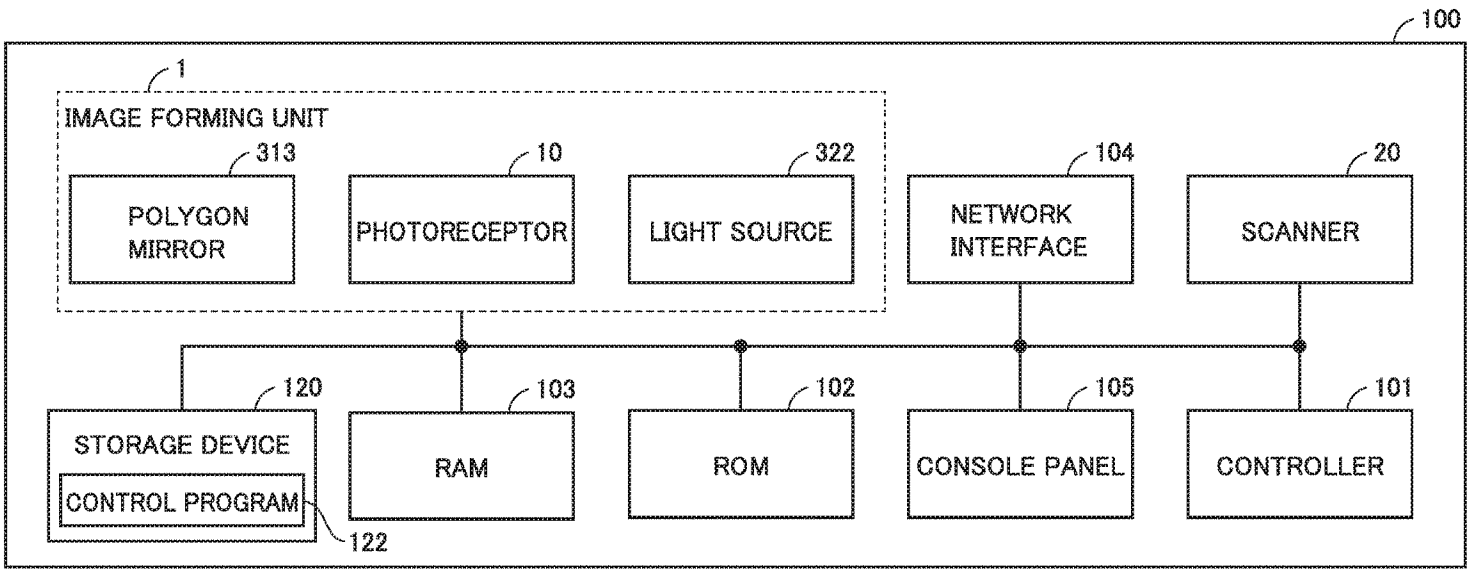
FIG. 4 is a block diagram showing a main hardware configuration of the image formation apparatus.

An example of a hardware configuration of image formation apparatus 100 will be described with reference to FIG. 4. FIG. 4 is a block diagram showing the main hardware configuration of image formation apparatus 100.

As shown in FIG. 4, image formation apparatus 100 includes a controller 101, a console panel 105, a ROM (Read Only Memory) 102, a RAM (Random Access Memory) 103, a storage device 120, a scanner 20, a network interface 104, and an image forming unit 1.

Controller 101 is composed of, for example, at least one integrated circuit. The integrated circuit is composed for example of at least one CPU (Central Processing Unit), at least one ASIC (Application Specific Integrated Circuit), at least one FPGA (Field Programmable Gate Array) or a combination thereof, or the like.

Controller 101 controls an operation of image formation apparatus 100 by executing various programs such as a control program 122 for adjusting a control parameter of image formation apparatus 100. In response to an instruction received to execute control program 122, controller 101 reads control program 122 from storage device 120 and loads it into RAM 103. RAM 103 functions as a working memory and temporarily stores various data necessary for executing control program 122.

An antenna (not shown) or the like is connected to network interface 104. Image formation apparatus 100 communicates data with an external communication device via the antenna. The external communication device includes, for example, a mobile communication terminal such as a smartphone, a server, and the like. Image formation apparatus 100 may be configured to download control program 122 from the server via the antenna.

Console panel 105 is composed of a display and a touch panel. The display and the touch panel overlap with each other and accept an operation done to image formation apparatus 100 via a touching operation. As an example, console panel 105 receives an operation for executing a control parameter adjustment process or the like. Console panel 105 includes a panel operation sensor to sense a user's panel operation. The panel operation sensor senses timing of starting preliminary rotation to rotate the polygon motor at a preliminary rotation speed.

Storage device 120 is, for example, a hard disk, an SSD (Solid State Drive) or another storage device. Storage device 120 may be either a built-in type or an external type. Storage device 120 stores control program 122 and the like according to the present embodiment. However, where control program 122 is stored is not limited to storage device 120, and may be stored in a storage area (for example, a cache) of controller 101, ROM 102, RAM 103, an external device (for example, a server), or the like.

Control program 122 may not be provided as a single program and may instead be incorporated into a part of any program and thus provided. In that case, a control process according to the present embodiment is implemented in cooperation with that any program. Even such a program that does not include some module does not depart from the gist of control program 122 according to the present embodiment. Furthermore, a function provided by control program 122 may partially or entirely be implemented by dedicated hardware. Further, image formation apparatus 100 may be configured in such a form as a so-called cloud service in which at least one server executes a part of a process done through control program 122.

[4. Controlling Rotation of Polygon Motor 314]

Figure 5:
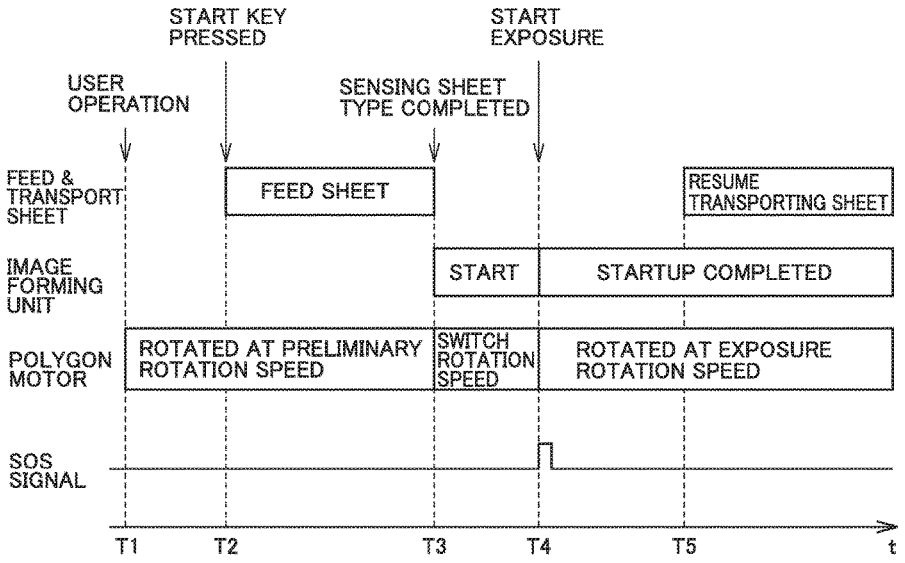
FIG. 5 is timing plots generally representing how rotation of a polygon motor is controlled.

With reference to FIG. 5, how rotation of polygon motor 314 is controlled according to the present embodiment will be described. FIG. 5 is timing plots generally representing how rotation of polygon motor 314 is controlled.

As shown in FIG. 5, in image formation apparatus 100 according to the present embodiment, when a user performs some operation on console panel 105 at any time (or at t=T1), polygon motor 314 is rotated at a preliminary rotation speed (corresponding to a first rotation speed). A "preliminary rotation speed" as referred to herein means a rotation speed of polygon motor 314 before exposure of photoreceptor 10 to light is started. Subsequently, when the user presses a start key to issue an instruction to start printing (i.e., at t=T2), feeding a sheet from cassette 37 is started.

Thereafter, the sheet transported through the transporting path is sensed by sheet sensor 45 for what type of sheet it is (at t=T3). When the type of the sheet is sensed by sheet sensor 45, an exposure rotation speed (corresponding to a second rotation speed) is determined based on the type of the sheet sensed, and the rotation speed of polygon motor 314 is switched from the preliminary rotation speed to the exposure rotation speed. An "exposure rotation speed" as referred to herein means a rotation speed of polygon motor 314 after exposure of photoreceptor 10 to light is started. The sheet in transporting path 41 is made to wait at registration roller 40 in order to adjust timing of feeding the sheet to secondary transfer roller 33.

When switching polygon motor 314 to the exposure rotation speed is completed (or at t=T4), exposure of photoreceptor 10 to light by print head 350 is started. Once a time to transport the sheet to secondary transfer roller 33 (i.e., t=T5) has arrived, registration roller 40 resumes transporting the sheet, and a toner image is formed on the sheet.

Figure 6A:
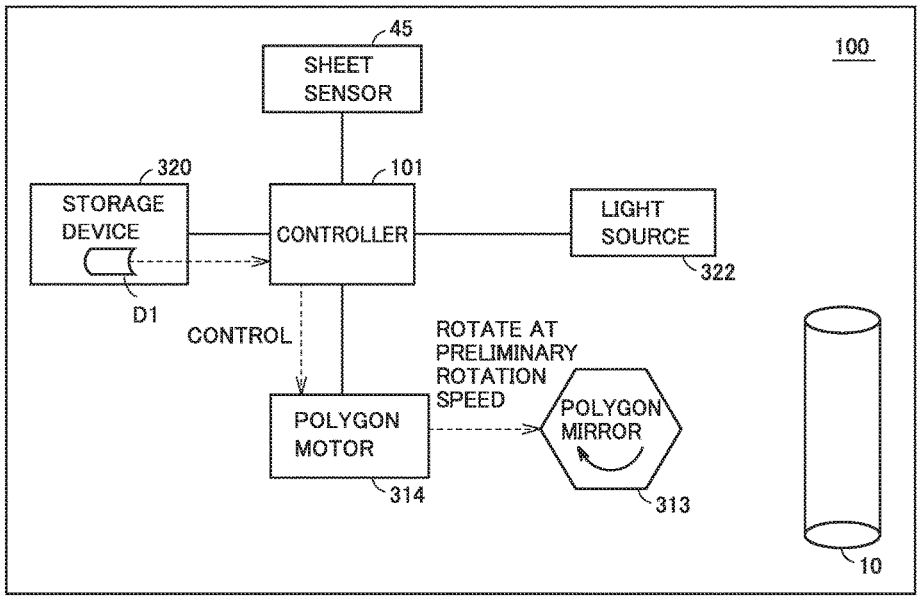
FIGS. 6A and 6B show a manner of controlling rotation of the polygon motor.
Figure 6B:
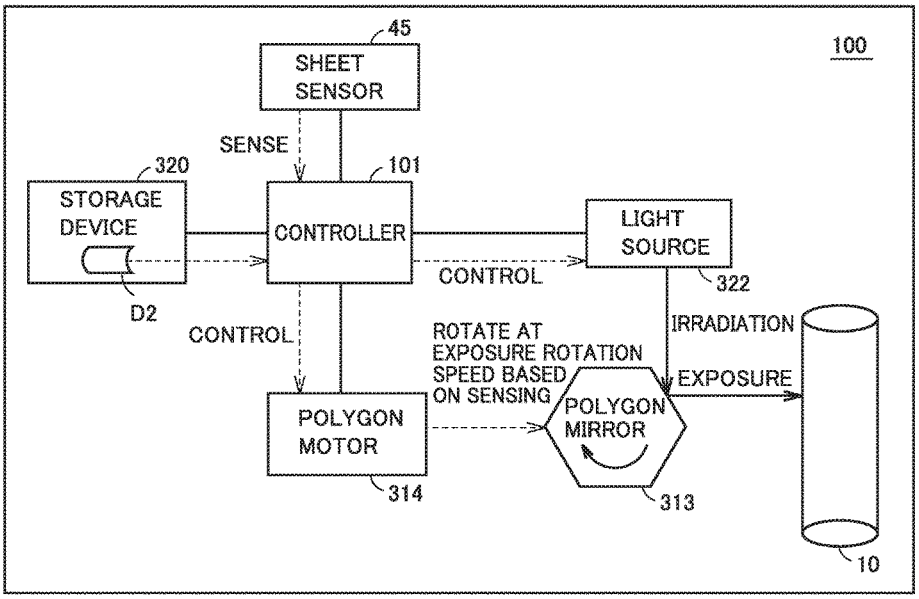

With reference to FIGS. 6A and 6B, how rotation of polygon motor 314 is controlled will be described. FIGS. 6A and 6B show a manner of controlling rotation of polygon motor 314. FIG. 6A shows a manner of control before exposure of photoreceptor 10 to light is started, and FIG. 6B shows a manner of control after exposure of photoreceptor 10 to light is started.

As shown in FIG. 6A, controller 101 of image formation apparatus 100 rotates polygon motor 314 at a preliminary rotation speed until sheet sensor 45 in transporting path 41 senses what type of sheet a sheet is. Controller 101 refers to a rotation speed history table D1 stored in storage device 120 to determine a preliminary rotation speed of polygon motor 314. A method for determining a preliminary rotation speed based on rotation speed history table D1 will be described later.

As shown in FIG. 6B, once sheet sensor 45 senses the type of the sheet, controller 101 determines an exposure rotation speed based on the type of the sheet sensed and a sheet type classification table D2 stored in storage device 120. Controller 101 rotates polygon motor 314 at the determined exposure rotation speed.

FIG. 7 is a diagram showing an example of sheet type classification table D2. As shown in FIG. 7, sheet type classification table D2 specifies, for example, a basis weight, a system rate, a resolution, a number of mirror planes, a number of beams, and an exposure rotation speed according to a sheet type (e.g., a plain sheet, a thick sheet, etc.). When sheet sensor 45 senses the basis weight of a sheet, controller 101 determines the type of the sheet based on the sensed result. Controller 101 rotates polygon motor 314 at an exposure rotation speed corresponding to the type of the sheet determined.

[5. Method for Determining Preliminary Rotation Speed]

Figure 9A:
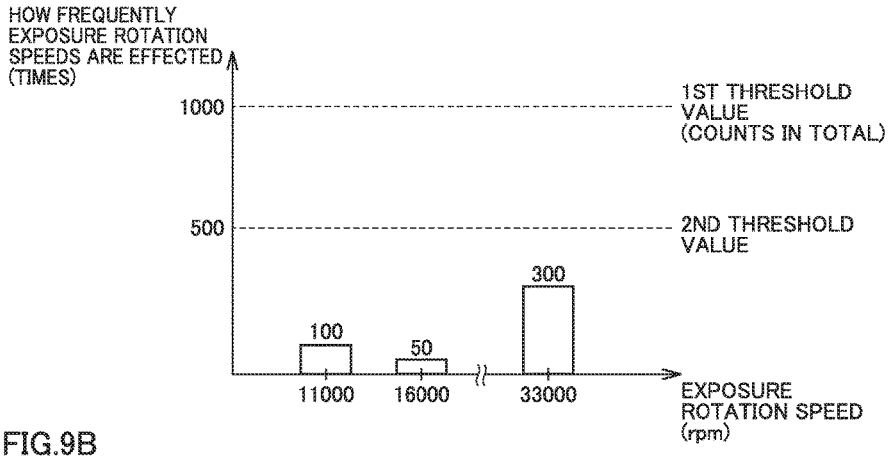
FIGS. 9A to 9C represent rotation speed history tables' contents in histograms.

With reference to FIGS. 8A to 8C and FIGS. 9A to 9 C, a method for determining a preliminary rotation speed will be described. FIGS. 8A to 8C show examples of rotation speed history table D1. FIGS. 8A to 8C show different examples of the rotation speed history table. FIGS. 9A to 9C represent each exemplary rotation speed history table's contents in a histogram. FIGS. 9A to 9C correspond to FIGS. 8A to 8C, respectively.

As shown in FIGS. 8A to 8C, as an example, rotation speed history table D1 records a sheet type, an exposure rotation speed, and how frequently the exposure rotation speed has previously been effected as history information. For example, an example shown in FIG. 8A indicates that an exposure rotation speed of 33,000 rpm has previously been effected 300 times, an exposure rotation speed of 16,000 rpm has previously been effected 50 times, and an exposure rotation speed of 11,000 rpm has previously been effected 100 times.

An example shown in FIG. 8B indicates that an exposure rotation speed of 33,000 rpm has previously been effected 600 times, an exposure rotation speed of 16,000 rpm has previously been effected 200 times, and an exposure rotation speed of 11,000 rpm has previously been effected 250 times. An example shown in FIG. 8C indicates that an exposure rotation speed of 33.000 rpm has previously been effected 700 times, an exposure rotation speed of 16.000 rpm has previously been effected 600 times, and an exposure rotation speed of 11,000 rpm has previously been effected 200 times.

Controller 101 determines a preliminary rotation speed to reduce a transition time required to transition from the preliminary rotation speed to an exposure rotation speed. Specifically, a preliminary rotation speed is determined to have a value between minimum and maximum rotation speeds of a plurality of candidate rotation speeds specified in rotation speed history table D1 (in the examples shown in FIGS. 8A to 8C, between 11,000 rpm and 33,000 rpm). In this way, a preliminary rotation speed can be set near a rotation speed that can be determined as an exposure rotation speed, and transitioning to the exposure rotation speed can be done in a reduced period of time.

Preferably, controller 101 determines a preliminary rotation speed to be equal to or less than an exposure rotation speed. Specifically, of the plurality of rotation speeds specified in rotation speed history table D1, a minimum rotation speed (11,000 rpm in the examples shown in FIGS. 8A to 8C) is set as a preliminary rotation speed. In controlling rotation of polygon motor 314, increasing a rotation speed takes more time than decreasing it. Accordingly, setting a preliminary rotation speed to be equal to or less than an exposure rotation speed further helps to reduce a time required to transition from the preliminary rotation speed to the exposure rotation speed.

As a specific method for determining a preliminary rotation speed, controller 101 determines whether how frequently the exposure rotation speeds specified in rotation speed history table D1 have been effected in total is (or has a history) equal to or more than a predetermined first threshold value. If how frequently the exposure rotation speeds have been effected in total is less than the first threshold value (hereinafter this is also referred to as a pattern 1), it is poor in reliability as a history of exposure rotation speeds effected, and controller 101 determines a preliminary rotation speed without considering how frequently each exposure rotation speed has been effected.

For example, for pattern 1, controller 101 determines as a preliminary rotation speed the lowest one of the exposure rotation speeds specified in rotation speed history table D1.

If how frequently the exposure rotation speeds specified in rotation speed history table D1 have been effected in total has a history equal to or more than the predetermined first threshold value (hereinafter this is also referred to as a pattern 2), it ensures reliability as a history of exposure rotation speeds effected, and controller 101 determines a preliminary rotation speed while considering how frequently each exposure rotation speed has been effected. Preferably, controller 101 determines the preliminary rotation speed to be equal to or greater than the minimum exposure rotation speed included in the history information and equal to or less than the maximum exposure rotation speed included in the history information.

As an example, for pattern 2, controller 101 determines whether the exposure rotation speeds have been effected as frequently as or more frequently than a second threshold value. When only one exposure rotation speed has been effected as frequently as or more frequently than the second threshold value (hereinafter this is also referred to as a pattern 2-1), controller 101 determines the exposure rotation speed as the preliminary rotation speed.

For pattern 2 with a plurality of exposure rotation speeds effected as frequently as or more frequently than the second threshold value (hereinafter this is also referred to as a pattern 2-2), controller 101 determines as the preliminary rotation speed an average value of the exposure rotation speeds effected as frequently as or more frequently than the second threshold value.

Figure 9B:
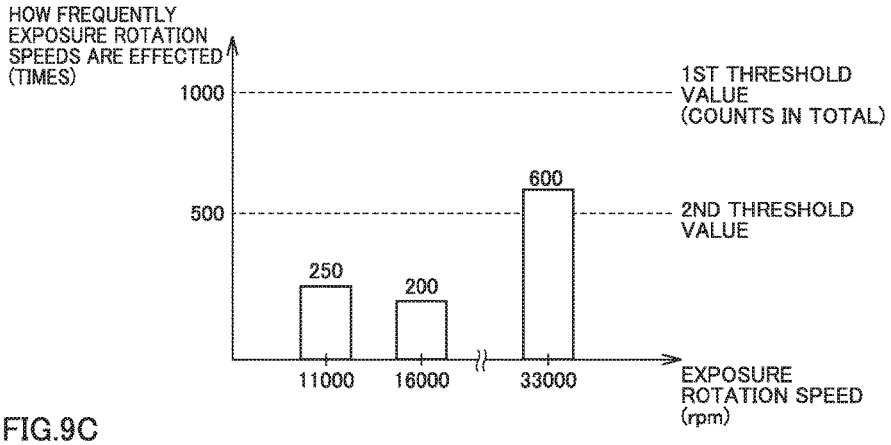
Figure 9C:
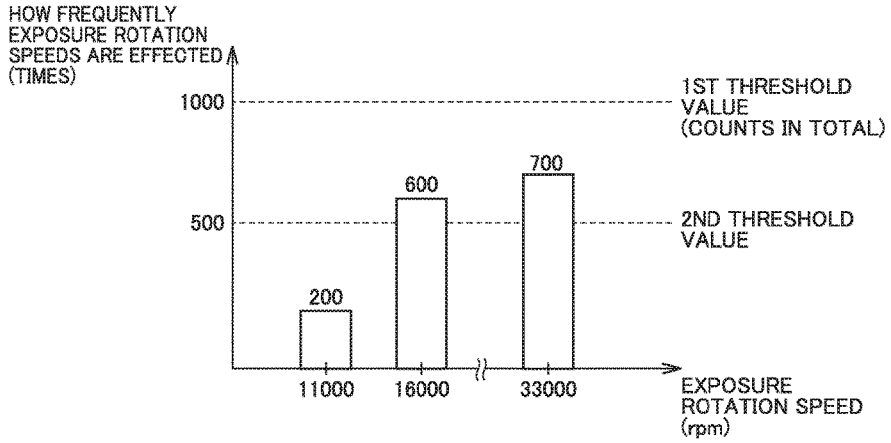

With reference to FIGS. 9A to 9C, the above-described method for determining a preliminary rotation speed will be described with reference to a specific example. In the present embodiment, the first threshold value is set to 1,000 times and the second threshold value is set to 500 times.

The example shown in FIG. 9A shows an exposure rotation speed history of 450 times for plain sheet, a thick sheet 1, and a thick sheet 2 altogether. Therefore, how frequently the exposure rotation speeds specified in rotation speed history table D1 have been effected in total (i.e., 450 times) has a history smaller than the first threshold value (i.e., 1,000 times). In that case, controller 101 determines that pattern 1 is applied, and determines the lowest rotation speed, or 11,000 rpm, as the preliminary rotation speed. The value of the first threshold value can be set as appropriate.

The example shown in FIG. 9B shows that how frequently the exposure rotation speeds have been effected in total has a history of 1,050 times for a plain sheet, thick sheet 1 and thick sheet 2 altogether, and thus exceeds the first threshold value (i.e., 1,000 times). And an exposure rotation speed for the plain sheet (i.e., 33,000 times) has been effected 600 times, which exceeds the second threshold value (i.e., 500 times). In that case, controller 101 determines that pattern 2-1 is applied, and determines 33,000 rpm as the preliminary rotation speed. The value of the second threshold value can be set as appropriate.

The example shown in FIG. 9C shows that how frequently the exposure rotation speeds have been effected in total has a history of 1,500 times for a plain sheet, thick sheet 1 and thick sheet 2 altogether, and thus exceeds the first threshold value (i.e., 1,000 times). And an exposure rotation speed for thick sheet 1 (i.e., 16,000 times) has been effected 600 times and an exposure rotation speed for the plain sheet (i.e., 33,000 times) has been effected 700 times, which exceed the second threshold value (i.e., 500 times). In that case, controller 101 determines that pattern 2-2 is applied, and determines an average value of 33.000 rpm and 16,000 rpm, or 24,500 rpm, as the preliminary rotation speed.

It should be noted that the method for determining a preliminary rotation speed is not limited to the above contents. For example, for pattern 2-2, a simple average of a plurality of values may be used, or how frequently each exposure rotation speed has been effected may be considered and accordingly, a weighted average value may be determined as a preliminary rotation speed.

When how frequently the exposure rotation speeds specified in rotation speed history table D1 have been effected in total has a history equal to or larger than the predetermined first threshold value (i.e., pattern 2 is applied) and any one of the exposure rotation speeds is less than the second threshold value, an average value of all of the exposure rotation speeds may be determined as a preliminary rotation speed. By doing so, a preliminary rotation speed can be determined without being affected by how frequently a specific exposure rotation speed has been effected.

[6. Process Procedure]

Figure 10:
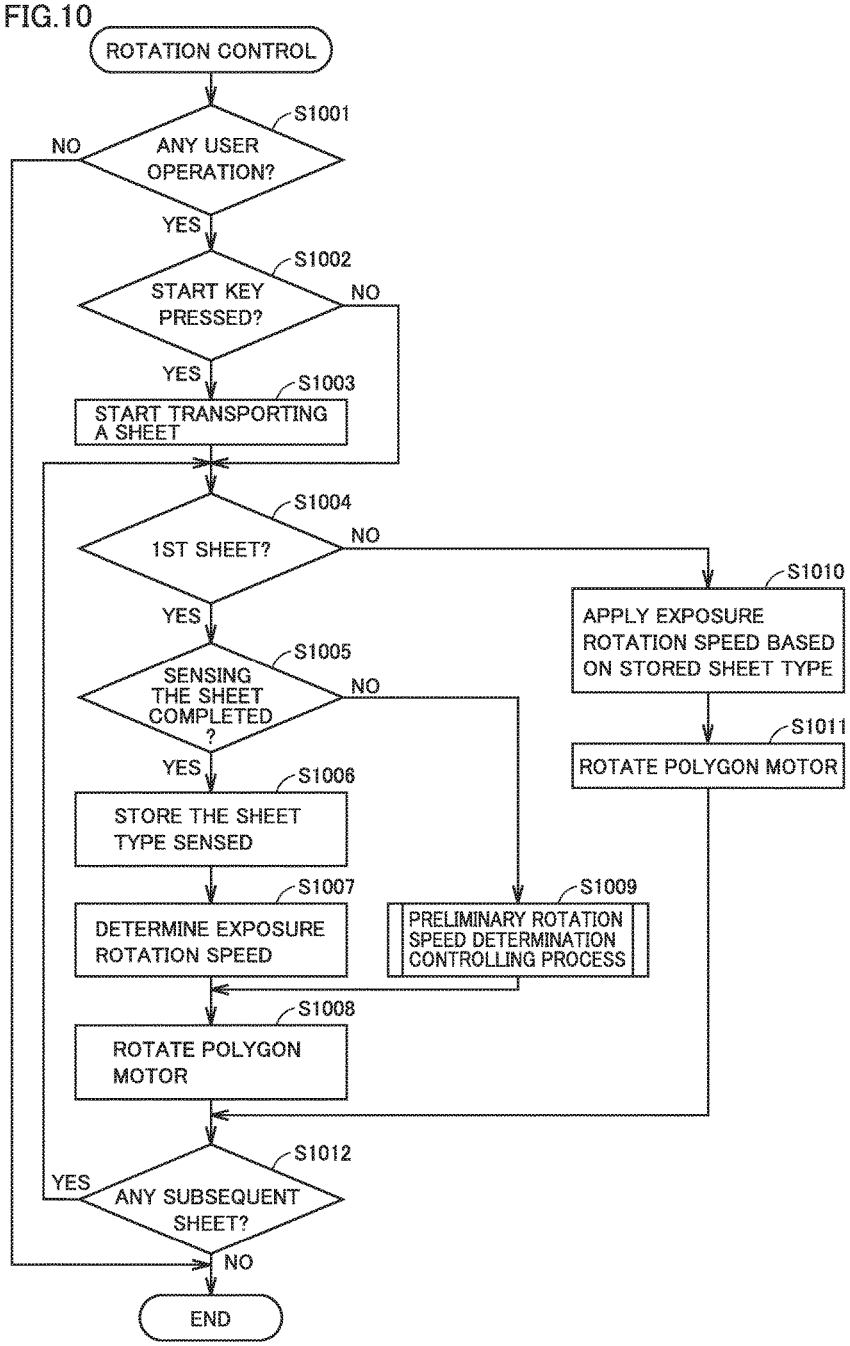
FIG. 10 is a flowchart of a procedure of a polygon motor rotation controlling process.
Figure 11:
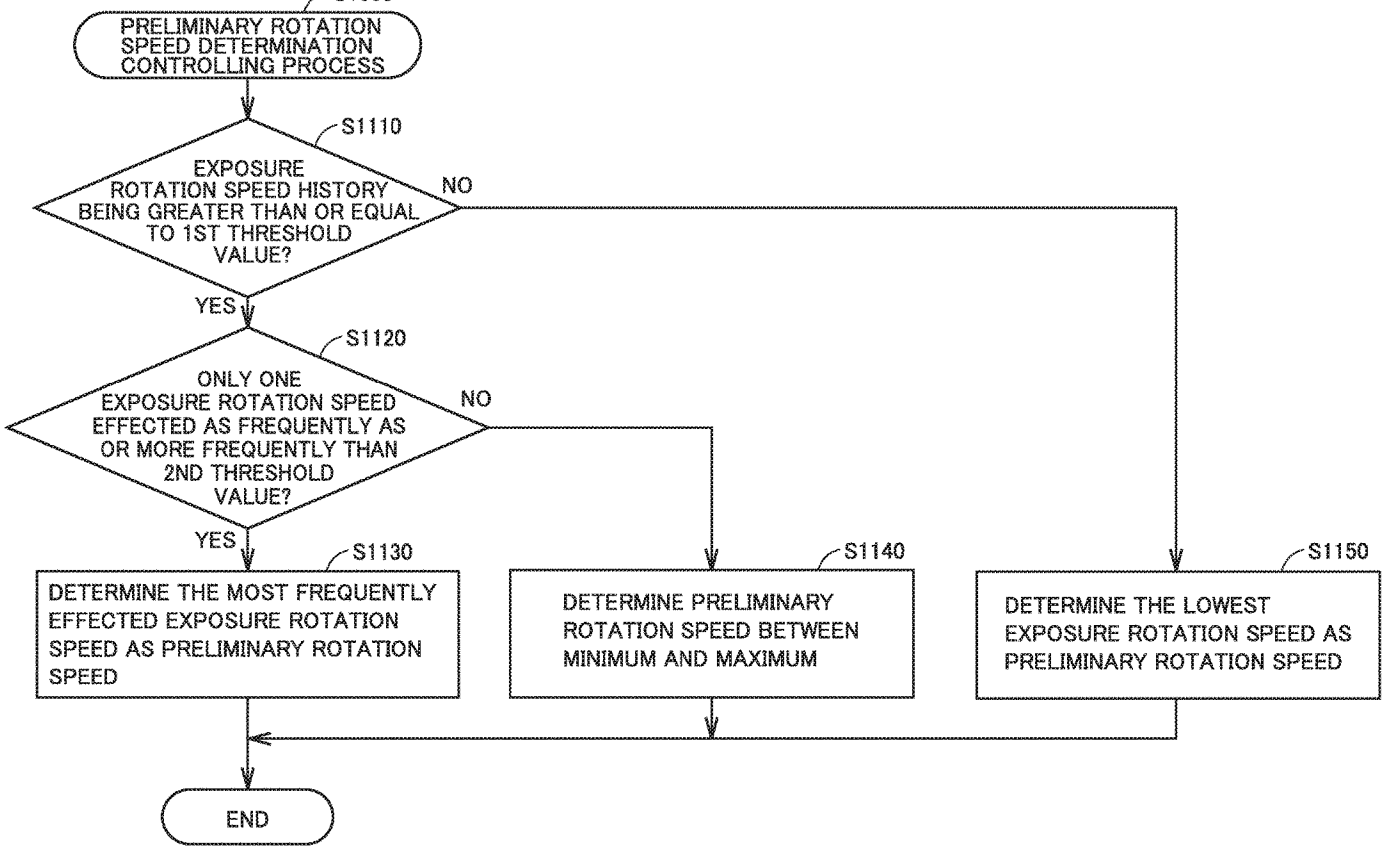
FIG. 11 is a flowchart of a preliminary rotation speed determination controlling procedure.

With reference to FIG. 10 and FIG. 11, a procedure of a process for controlling rotation of polygon motor 314 will be described. FIG. 10 is a flowchart of the procedure of the process for controlling rotation of polygon motor 314. FIG. 11 is a flowchart of a preliminary rotation speed determination controlling procedure. This process is implemented for example by a CPU that functions as controller 101 executing a given program.

In step S1001, controller 101 determines whether any operation is done by a user. When the user performs some operation (YES in step S1001), controller 101 proceeds to step S1002. Otherwise (NO in step S1001), controller 101 ends the process.

In step S1002, controller 101 determines whether the start key has been pressed to start printing. When the start key is pressed (YES in step S1002), controller 101 proceeds to step S1003. Otherwise (NO in step S1002), controller 101 proceeds to step S1004.

In step S1003, controller 101 starts transporting a sheet from cassette 37 into transporting path 41. Controller 101 proceeds to step S1004.

In step S1004, controller 101 determines whether a sheet on which an image is to be formed is the first sheet in a print job, based on data of a status of execution of the print job. When the sheet is the first sheet (YES in step S1004), controller 101 proceeds to step S1005. Otherwise (NO in step S1004), controller 101 proceeds to step S1010.

As will be described below, in the present embodiment, in the case of printing on a plurality of sheets, when printing on the first one of the sheets, controller 101 only senses the type of that first sheet.

In step S1005, controller 101 determines whether sheet sensor 45 has completed sensing the type of the sheet. When sensing the type of the sheet has been completed (YES in step S1005), controller 101 proceeds to step S1006. Otherwise (NO in step S1005), controller 101 proceeds to step S1009.

In step S1006, controller 101 stores the sheet type sensed by sheet sensor 45. Controller 101 proceeds to step S1007.

In step S1007, controller 101 determines an exposure rotation speed based on the sensed sheet type. Controller 101 proceeds to step S1008.

In step S1009, controller 101 performs the preliminary rotation speed determination controlling process. The preliminary rotation speed determination controlling process will be described hereinafter more specifically. Controller 101 proceeds to step S1008.

In step S1008, controller 101 rotates polygon motor 314. Controller 101 proceeds to step S1012.

In step S1010, controller 101 determines an exposure rotation speed based on a stored sheet type. Controller 101 proceeds to step S1011.

In step S1011, controller 101 rotates polygon motor 314. Controller 101 proceeds to step S1012.

In step S1012, controller 101 determines whether there is any following sheet. If there is any following sheet (YES in step S1012), controller 101 returns to step S1004. Otherwise (NO in step S1012), controller 101 ends the process.

Referring to FIG. 11, a procedure of a process for controlling determination of preliminary rotation speed (step S1009) will be described.

In step S1110, controller 101 refers to rotation speed history table D1 to determine whether how frequently the exposure rotation speeds specified therein have been effected in total has a history greater than or equal to the first threshold value. If so (YES in step S110), controller 101 proceeds to step S1120. Otherwise (NO in step S1110), controller 101 proceeds to step S1150.

In step S1120, controller 101 determines whether only one exposure rotation speed has been effected as frequently as or more frequently than the second threshold value. If there is only one candidate exposure rotation speed effected as frequently as or more frequently than the second threshold value (YES in step S1120), controller 101 proceeds to step S1130. Otherwise (NO in step S1120), controller 101 proceeds to step S1140.

In step S1130, controller 101 determines as a preliminary rotation speed an exposure rotation speed most frequently effected in rotation speed history table D1. Controller 101 ends the process.

In step S1140, controller 101 determines a preliminary rotation speed to be equal to or more than a minimum exposure rotation speed included in rotation speed history table D1 and equal to or less than a maximum exposure rotation speed included in rotation speed history table D1. Controller 101 ends the process.

In step S1150, controller 101 determines as a preliminary rotation speed the lowest one of candidate exposure rotation speeds. Controller 101 ends the process.

[7. Sub-Summary]

Thus, in the present embodiment, controller 101 rotates polygon motor 314 at a preliminary rotation speed until sheet sensor 45 in transporting path 41 senses a sheet type, and once sheet sensor 45 has sensed the sheet type, controller 101 determines an exposure rotation speed based on the sensed sheet type, and controller 101 rotates polygon motor 314 at the determined exposure rotation speed.

With the above-described configuration, polygon motor 314 is rotated at a preliminary rotation speed before a sheet type is sensed and an exposure rotation speed is determined, and polygon motor 314 can thus be started up quickly.

Second Embodiment

[1. Outline]

Hereinafter, a second embodiment will be described. In the first embodiment, polygon motor 314 is controlled on the premise that a sheet type is sensed, whereas a second embodiment differs from the first embodiment in that an operation mode includes a first mode in which no sheet type is sensed and a second mode in which a sheet type is sensed, and different processes for control regarding rotation of polygon motor 314 are performed in the first and second modes, respectively.

Note that the process for control regarding rotation means controlling various parameter values for controlling rotation of polygon motor 314, and for example, it can include controlling a value of a current applied to polygon motor 314, controlling a value of a voltage applied to polygon motor 314, and the like. In the present embodiment, any configuration similar to that of image formation apparatus 100 according to the above-described embodiment is denoted with a reference character identical to that of image formation apparatus 100. Accordingly, it will not be described redundantly.

[2. Details]

Figure 12:
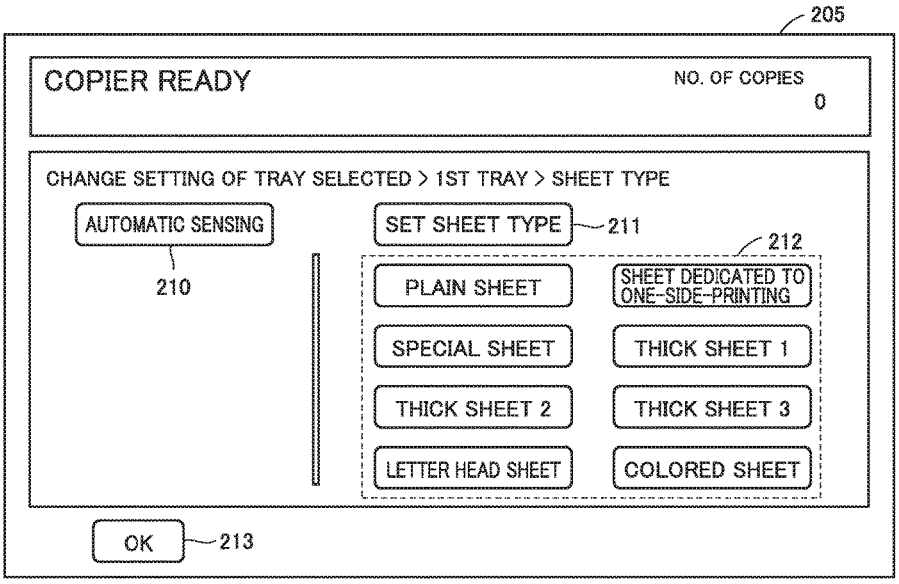
FIG. 12 is an example of an indication displayed by a console panel comprised by the image formation apparatus according to a second embodiment.

FIG. 12 is an example of an indication displayed by console panel 205 comprised by an image formation apparatus 200 according to the second embodiment. As shown in FIG. 12, console panel 205 displays a screen allowing a user to select whether a sheet type is automatically sensed or the user sets a sheet type.

When the user selects an automatic sensing button 210 and presses an OK button 213, the second mode is set to sense a sheet type by sheet sensor 45. On the other hand, when the user presses a sheet type setting button 211 and, in that condition, selects one of sheet type buttons 212 and presses OK button 213, the first mode is set to avoid sensing any sheet type by sheet sensor 45. Thus image formation apparatus 200 is configured to allow a user to select either the first mode or the second mode.

Figure 13A:
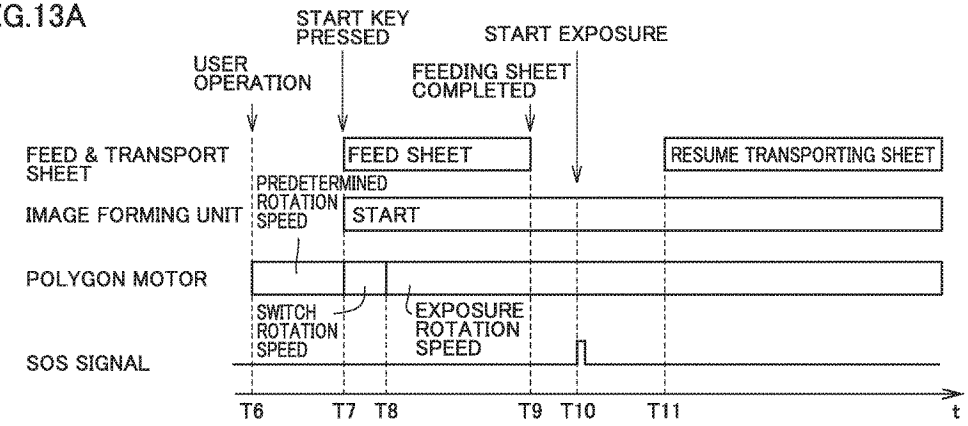
FIGS. 13A and 13B are timing plots outlining controlling rotation of the polygon motor according to the second embodiment.
Figure 13B:
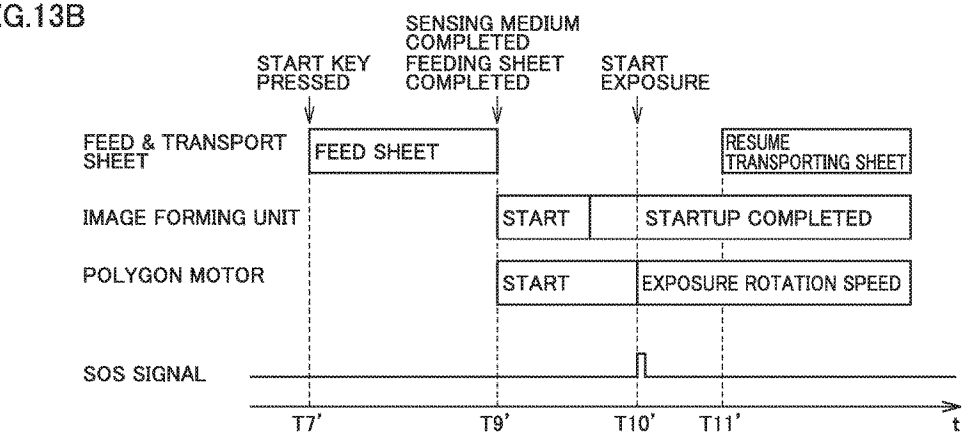

With reference to FIGS. 13A and 13B, how rotation of polygon motor 314 is controlled according to the second embodiment will be described. FIGS. 13A and 13B are timing plots outlining controlling rotation of polygon motor 314 according to the second embodiment.

FIG. 13A shows timing plots in the first mode. In image formation apparatus 200 in the first mode when a user performs any operation on console panel 205 at any time (at t=T6), polygon motor 314 is rotated at a predetermined rotation speed.

Thereafter, when the user presses the start key to input an instruction to start printing (at t=T7), feeding a sheet from cassette 37 is started and image forming unit 1 is activated. Further, the rotation speed of polygon motor 314 is switched to attain an exposure rotation speed corresponding to a sheet type set by the user when the user inputs an instruction to perform printing, and thereafter when a predetermined period of time has elapsed (or at t=T8) switching the rotation speed of polygon motor 314 is completed.

Thereafter, feeding the sheet in transporting path 41 is completed and when the sheet is made to wait at registration roller 40 (or at t=T9) exposure of photoreceptor 10 to light by print head 350 is started (at t=T10). When a time arrives to transport the sheet to secondary transfer roller 33 (or at t=T11), registration roller 40 resumes transporting the sheet, and a toner image is formed on the sheet.

FIG. 13B shows timing plots in the second mode. In the second mode, when image formation apparatus 200 has the start key pressed by a user to input an instruction to start printing (i.e., at t=T7'), feeding a sheet from cassette 37 is started.

Thereafter, the sheet is transported through the transporting path and sensed by sheet sensor 45 for what type of sheet it is (at t=T9'). Once the type of the sheet has been sensed by sheet sensor 45, an exposure rotation speed is determined based on the type of the sheet sensed, and polygon motor 314 is actuated. The sheet in transporting path 41 is made to wait at registration roller 40 in order to adjust timing of feeding the sheet to secondary transfer roller 33.

Thereafter, when actuating polygon motor 314 to attain the exposure rotation speed is completed (or at t=T10'), exposure of photoreceptor 10 to light by print head 350 is started. When a time arrives to transport the sheet to secondary transfer roller 33 (or at t=T11'), registration roller 40 resumes transporting the sheet, and a toner image is formed on the sheet.

Figure 14A:
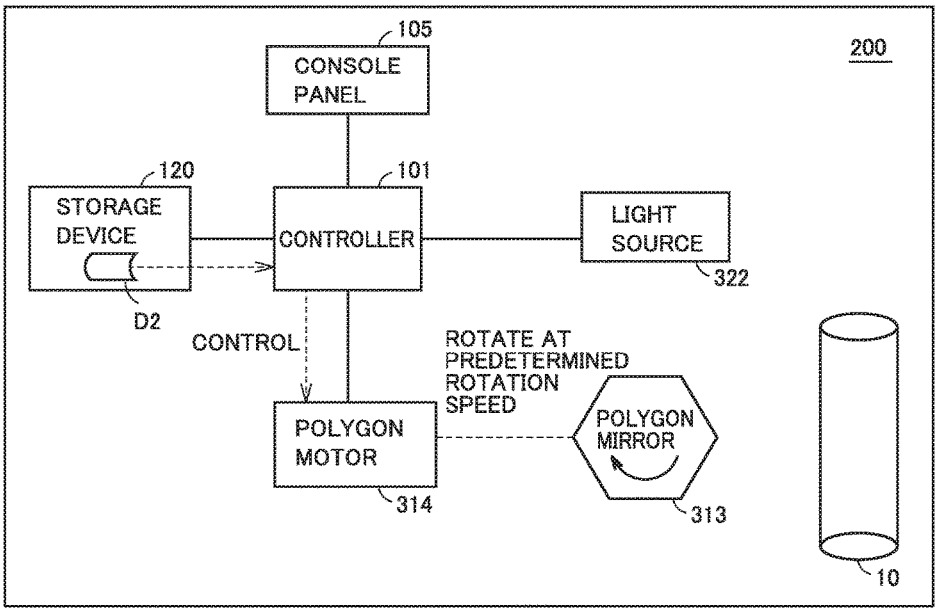
FIGS. 14A and 14B show a manner of controlling rotation of the polygon motor in a first mode.
Figure 14B:
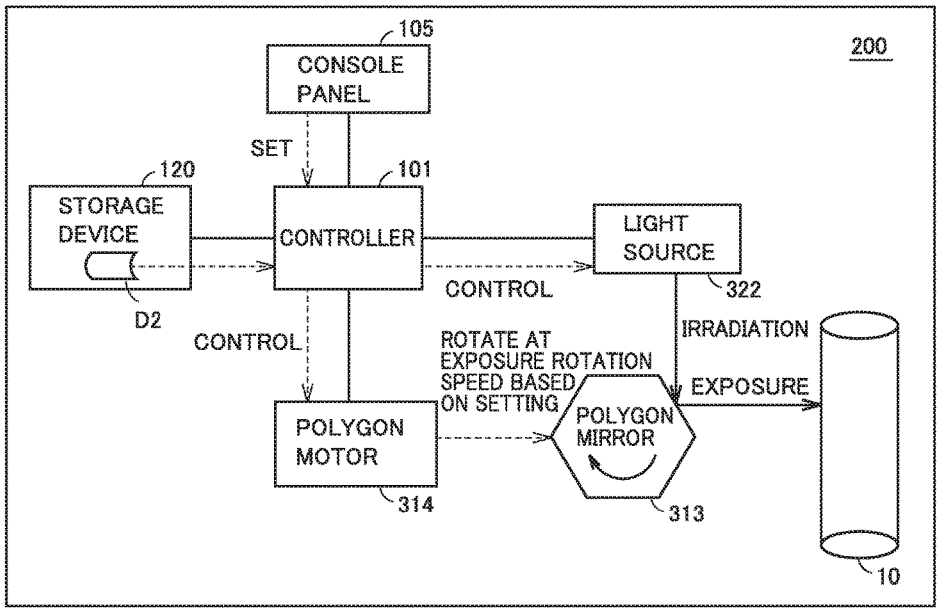
Figure 15A:
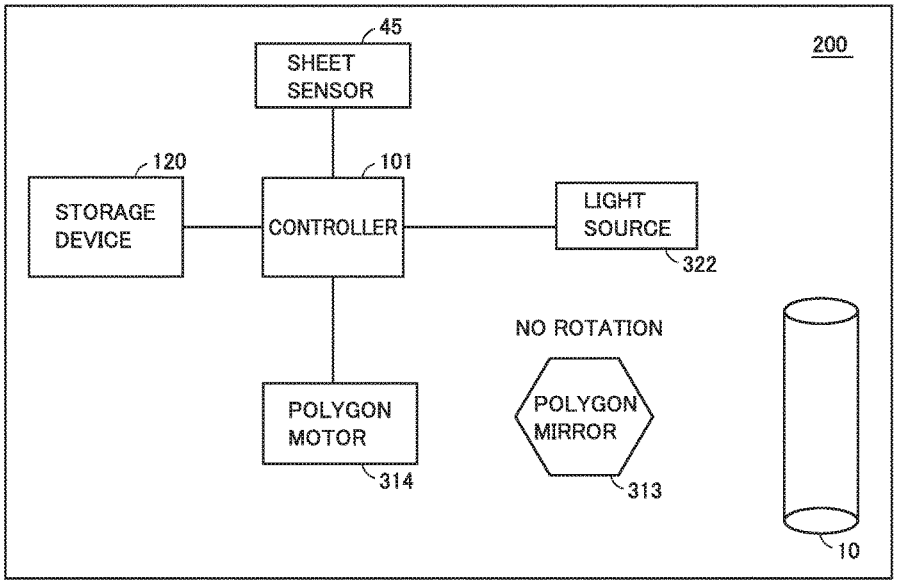
FIGS. 15A and 15B show a manner of controlling rotation of the polygon motor in a second mode.
Figure 15B:
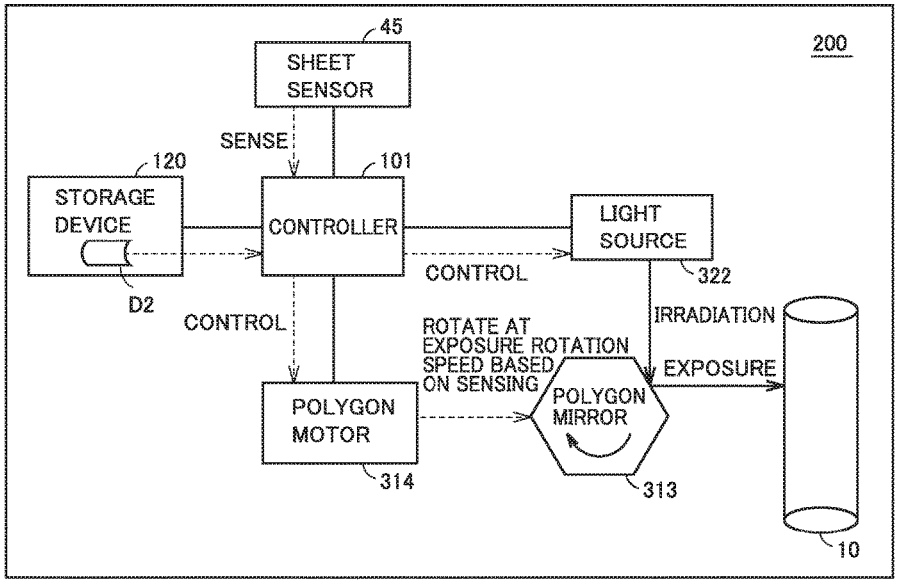

A functional configuration for controlling rotation of polygon motor 314 according to the second embodiment will be described with reference to FIGS. 14A and 14B and FIGS. 15A and 15B. FIGS. 14A and 14B are functional block diagrams in controlling rotation of polygon motor 314 in the first mode. FIGS. 15A and 15B are functional block diagrams in controlling rotation of polygon motor 314 in the second mode.

With reference to FIGS. 14A and 14B, a functional configuration for controlling rotation as described above in the first mode will be described. As shown in FIG. 14A, image formation apparatus 200 includes a controller 201, which rotates polygon motor 314 at a predetermined rotation speed until exposure of photoreceptor 10 to light is started. The predetermined rotation speed can be, for example, an exposure rotation speed applied in a case where a sheet type specified in sheet type classification table D2 is a plain sheet.

As shown in FIG. 14B, when exposure of photoreceptor 10 to light is started, controller 201 sets, based on a sheet type set via console panel 105 and sheet type classification table D2, an exposure rotation speed corresponding to the set sheet type. Controller 201 rotates polygon motor 314 at the determined exposure rotation speed.

With reference to FIGS. 15A and 15B, a functional configuration for controlling rotation as described above in the second mode will be described. As shown in FIG. 15A, controller 201 of image formation apparatus 200 rotates polygon motor 314 until sheet sensor 45 in transporting path 41 senses what type of sheet a sheet is.

As shown in FIG. 15B, once sheet sensor 45 senses the type of the sheet, controller 201 determines, based on the type of the sheet sensed and sheet type classification table D2 stored in storage device 120, an exposure rotation speed corresponding to the set sheet type. Controller 201 rotates polygon motor 314 at the determined exposure rotation speed.

[3. Process Procedure]

Figure 16:
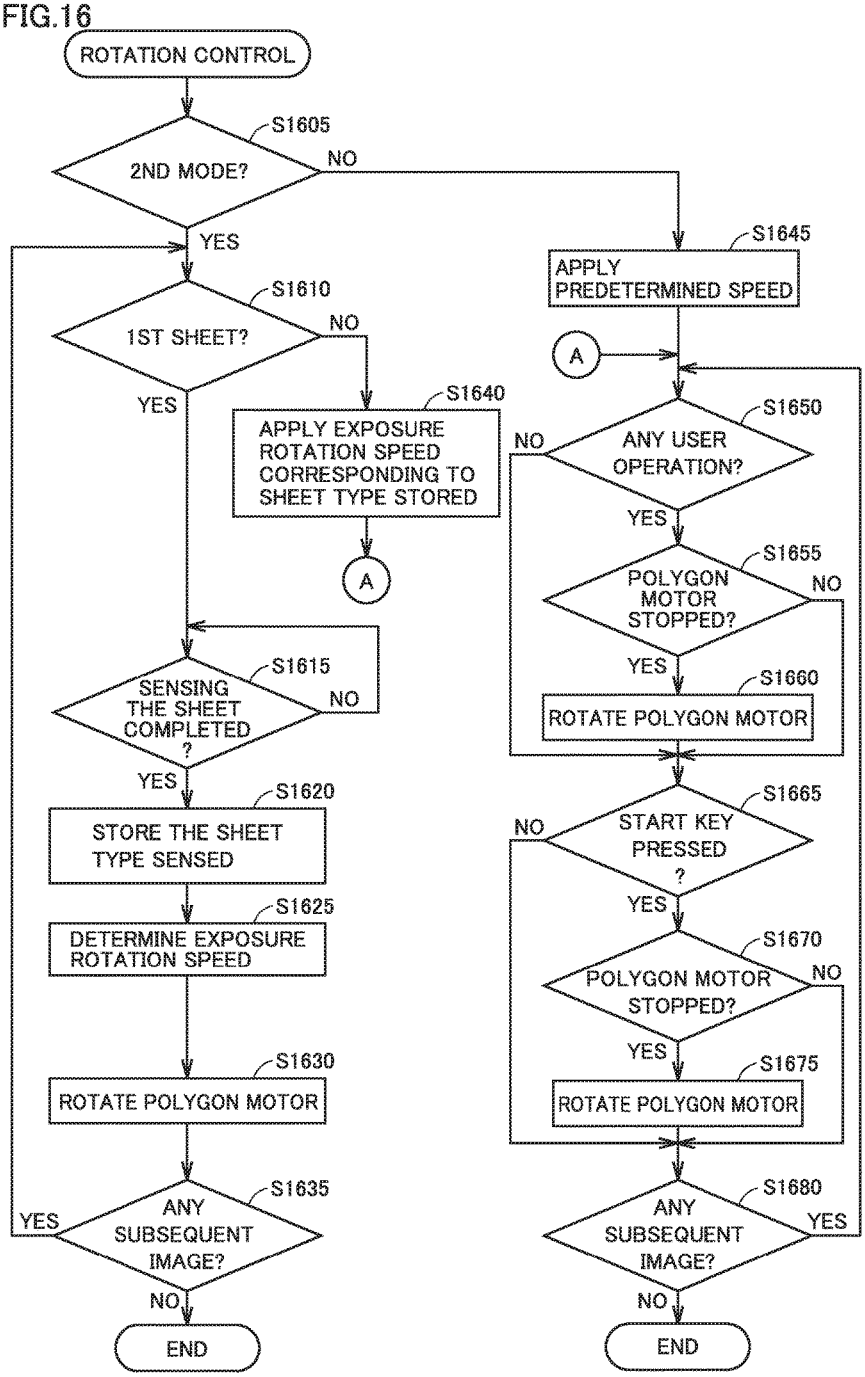
FIG. 16 is a flowchart of a procedure of a polygon motor rotation controlling process according to the second embodiment.

With reference to FIG. 16, a procedure of a process for controlling rotation of polygon motor 314 according to the second embodiment will be described. FIG. 16 is a flowchart of a procedure of the process for controlling rotation of polygon motor 314 according to the second embodiment. This process is implemented for example by a CPU that functions as controller 201 executing a given program.

In step S1605, controller 201 determines whether an operation mode is the second mode. When the operation mode is the second mode (YES in step S1605), controller 201 proceeds to step S1610. Otherwise (NO in step S1605), controller 201 proceeds to step S1645.

In step S1610, controller 201 determines whether a sheet on which an image is to be formed is the first sheet in a print job. When the sheet is the first sheet (YES in step S1610), controller 201 proceeds to step S1615. Otherwise (NO in step S1610), controller 201 proceeds to step S1640.

As will be described below, in the present embodiment, in the second mode, in printing on a plurality of sheets when printing on the first one of the sheets, controller 201 does not rotate polygon motor 314 before exposure of photoreceptor 10 to light is started; rather, after sheet sensor 45 has sensed a sheet type, controller 101 rotates polygon motor 314 at a speed determined based on the sheet type sensed by the sheet sensor.

Then, when printing on the second sheet et seq., before starting exposure of the photoreceptor to light, controller 201 rotates the motor at an exposure rotation speed determined based on the sheet type sensed from the first sheet.

In step S1615, controller 201 determines whether the type of the sheet has been sensed. When the type of the sheet has been sensed (YES in step S1615), controller 201 proceeds to step S1620. Otherwise (NO in step S1615), controller 201 repeats step S1615.

In step S1620, controller 201 stores the sensed sheet type in storage device 120. Controller 201 proceeds to step S1625.

In step S1625, controller 201 determines the rotation speed corresponding to the sensed sheet type as the rotation speed of polygon motor 314. Controller 201 proceeds to step S1630.

In step S1630, controller 201 rotates polygon motor 314. Controller 201 proceeds to step S1635.

In step S1635, controller 201 determines whether there is any image to be formed on a subsequent sheet. If there is any image to be formed on a subsequent sheet (YES in step S1635), controller 201 returns to step S1610. Otherwise (NO in step S1635), controller 201 ends the process.

In step S1640, controller 201 determines the rotation speed corresponding to a sheet type stored in storage device 120 as the exposure rotation speed of polygon motor 314. Controller 201 proceeds to step S1650.

In step S1645, controller 201 sets a predetermined speed as the rotation speed of polygon motor 314. Controller 201 proceeds to step S1650.

In step S1650, controller 201 determines whether any operation is done by the user via console panel 105. When the user performs some operation (YES in step S1650), controller 201 proceeds to step S1655. Otherwise ((NO in step S1650), the process proceeds to step S1655.

In step S1655, controller 201 determines whether polygon motor 314 is stopped. When polygon motor 314 is stopped (YES in step S1655), controller 201 proceeds to step S1660. Otherwise (NO in step S1655), controller 201 proceeds to step S1665.

In step S1660, controller 201 rotates polygon motor 314. Controller 201 proceeds to step S1665.

In step S1665, controller 201 determines whether the start key has been pressed. When the start key has been pressed (YES in step S1665), controller 201 proceeds to step S1670. Otherwise (NO in step S1665), controller 201 proceeds to step S1680.

In step S1670, controller 201 determines whether polygon motor 314 is stopped. When polygon motor 314 is stopped (YES in step S1670), controller 201 proceeds to step S1675. Otherwise (NO in step S1670), controller 201 proceeds to step S1680.

In step S1675, controller 201 rotates polygon motor 314. Controller 201 proceeds to step S1680.

In step S1680, controller 201 determines whether there is any image to be formed on a subsequent sheet. If there is any image to be formed on a subsequent sheet (YES in step S1680), controller 201 returns to step S1650. Otherwise (NO in step S1680), controller 201 ends the process.

[4. Sub-Summary]

Thus image formation apparatus 200 includes as operation modes a first mode in which no sheet type is sensed and a second mode in which a sheet type is sensed. Controller 201 performs different processes for control regarding rotation of the polygon motor in the first and second modes, respectively.

The above configuration allows the polygon motor to be controlled more appropriately depending on whether a sheet sensing process is performed. This can enhance convenience for users, and also eliminate unnecessarily controlling rotation of the polygon motor and hence allows consumable items to have an extended service life.

Third Embodiment

[1. Outline]

Hereinafter, a third embodiment will be described. In the third embodiment an image formation apparatus 300 includes as operation modes a first mode in which no sheet type is sensed and a second mode in which a sheet type is sensed. Controller 301 in the second mode rotates polygon motor 314 at a preliminary rotation speed until sheet sensor 45 senses a sheet type, and once sheet sensor 45 has sensed a sheet type, controller 301 determines an exposure rotation speed based on the sensed sheet type, and controller 301 rotates polygon motor 314 at the determined exposure rotation speed. Image formation apparatus 300 according to the present embodiment is implemented by the same configuration as that of image formation apparatus 100 according to the above-described embodiments. Accordingly, it will not be described redundantly.

[2. Details]

Figure 17:
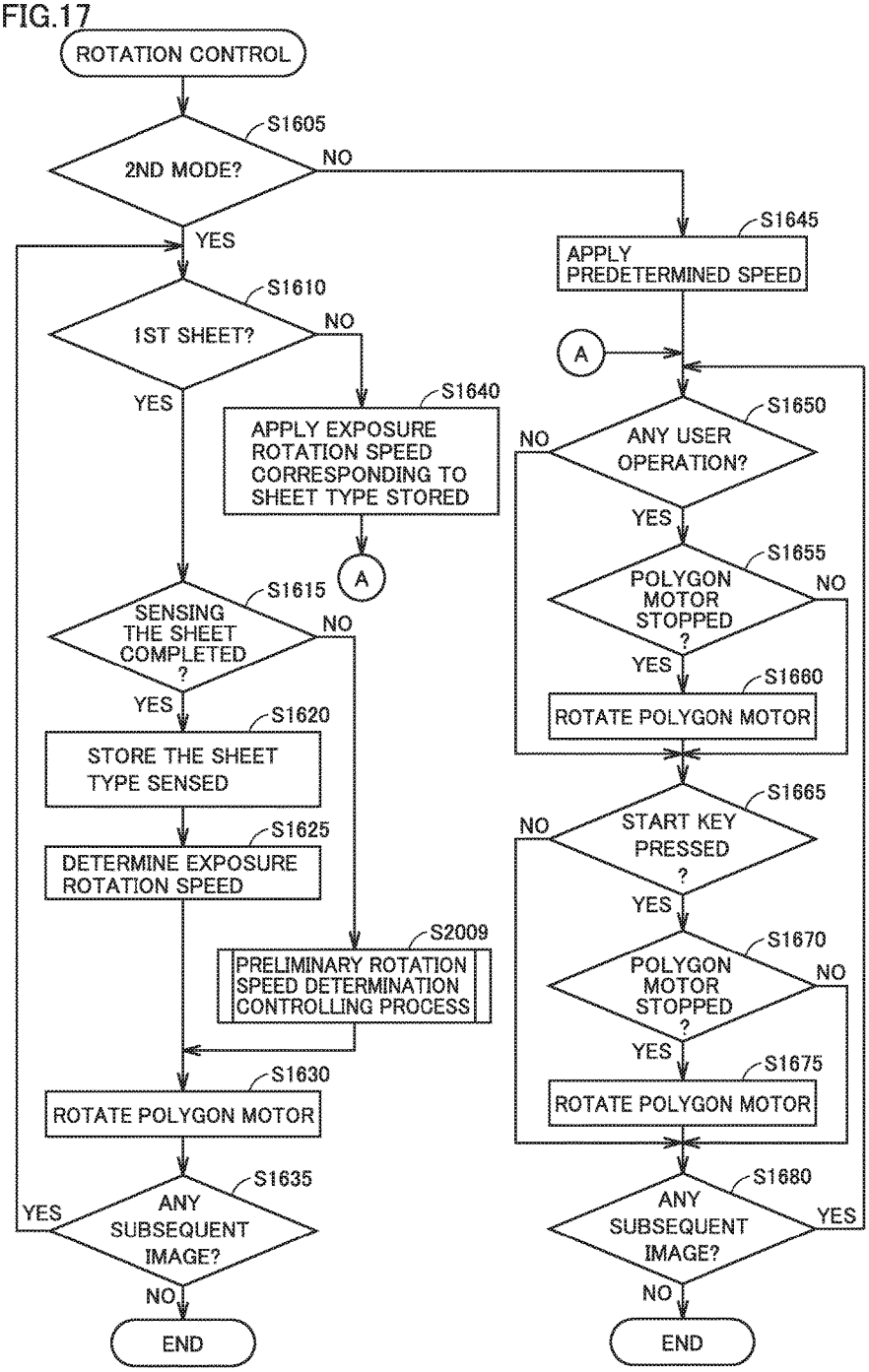
FIG. 17 is a flowchart of a procedure of a polygon motor rotation controlling process according to a third embodiment.
Figure 18:
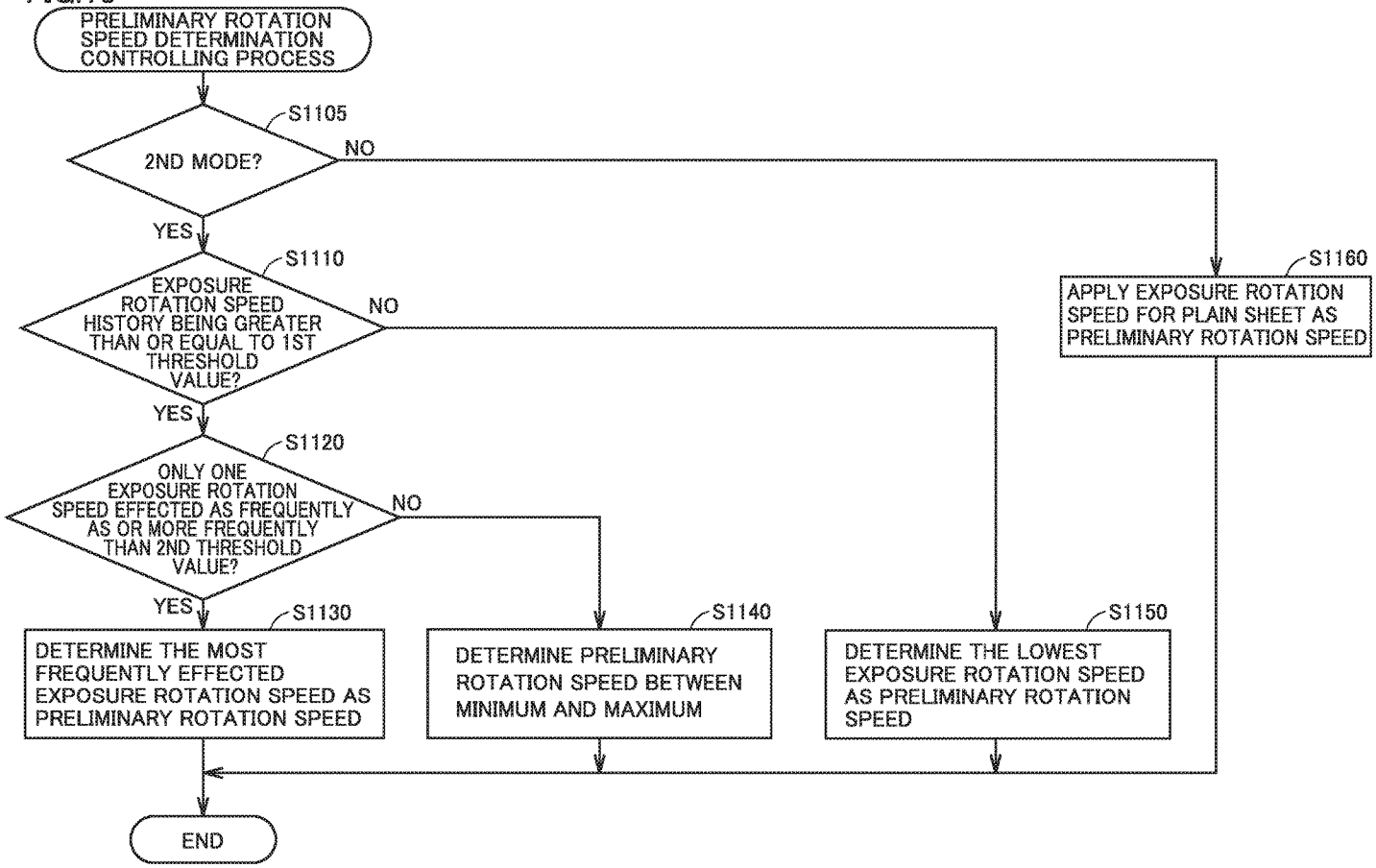
FIG. 18 is a flowchart of a first rotation speed determination controlling procedure according to the third embodiment.

With reference to FIG. 17 and FIG. 18, a procedure of a process for controlling rotation of polygon motor 314 will be described. FIG. 17 is a flowchart of a procedure of a process for controlling rotation of polygon motor 314 according to the third embodiment. FIG. 18 is a flowchart of the preliminary rotation speed determination controlling procedure according to the third embodiment. This process is implemented for example by a CPU that functions as controller 301 executing a given program.

For FIG. 17, no description will be provided repeatedly for any step that is identical to that described in the second embodiment. In step S1615, if controller 301 determines that sensing the type of the sheet has not been completed (NO in step S1615), controller 301 proceeds to step S2009. In step S2009, the preliminary rotation speed determination controlling process is performed.

Referring to FIG. 18, the preliminary rotation speed determination controlling process (step S2009) will be described. For FIG. 18, no description will be provided repeatedly for any step that is identical to that described in the first embodiment. In step S1105, controller 301 determines whether an operation mode is the second mode. When the operation mode is the second mode (YES in step S1105), controller 301 proceeds to step S1110. Otherwise (NO in step S1105), controller 301 proceeds to step S1160.

In step S1160, controller 301 determines a predetermined rotation speed (for example, an exposure rotation speed for a plain sheet) as a preliminary rotation speed. Controller 301 ends the process.

[3. Sub-Summary]

Thus, in the third embodiment, controller 301 in the second mode in which a sheet type is sensed rotates polygon motor 314 at a preliminary rotation speed determined based on rotation speed history table D1 before exposure to light is started.

The above configuration allows the polygon motor to be started up quickly while allowing the polygon motor to be controlled more appropriately depending on whether a sheet sensing process is performed.

Other Embodiments

While in the above embodiments when a print job is performed on a plurality of sheets the type of only the first sheet for the print job is sensed, the type of only the first one of the sheets set in cassette 37 may instead be sensed. This allows the sheet sensing process to be less frequently performed than when the type of the first sheet for a print job is sensed. In that case, for example, it can be determined based on whether a sheet tray is lifted up after sheets are set in cassette 37. This case is also as effective as the above embodiments.

Summary

According to one aspect, an image formation apparatus comprises: a light source configured to emit laser light; a polygon mirror configured to reflect the laser light; a photoreceptor configured to be exposed to the laser light reflected by the polygon mirror; a motor configured to rotate the polygon mirror; and a controller configured to sense a type of a sheet transported through the image formation apparatus. The image formation apparatus includes as operation modes a first mode in which no sheet type is sensed and a second mode in which a sheet type is sensed. The controller performs different processes for control regarding rotation of the motor in the first and second modes, respectively.

Preferably, in the first mode the controller starts rotating the motor at a predetermined time point before exposure of the photoreceptor to light is started.

Preferably, the image formation apparatus is configured to receive a setting of a rotation speed of the motor, and in the first mode the controller rotates the motor at a rotation speed in accordance with the setting after exposure of the photoreceptor to light is started.

Preferably, in the second mode the controller does not rotate the motor before a type of a sheet is sensed.

Preferably, in the second mode the controller rotates the motor after a type of a sheet is sensed, the motor being rotated at a rotation speed determined based on the type of the sheet sensed.

Preferably, in the second mode, in printing on a plurality of sheets when printing on a first one of the sheets the controller does not rotate the motor before a type of the sheet is sensed and instead after the type of the sheet is sensed the controller rotates the motor at a speed determined based on the type of the sheet sensed.

Preferably, in the second mode, in printing on the plurality of sheets when printing on a second one et seq. of the sheets, before starting exposure of the photoreceptor to light the controller rotates the motor at a rotation speed determined based on the type of the first sheet sensed.

Preferably, the image formation apparatus is configured to allow either the first mode or the second mode to be selected.

In another aspect, a control program for controlling an image formation apparatus is provided. The image formation apparatus includes: a light source configured to emit laser light; a polygon mirror configured to reflect the laser light; a photoreceptor configured to be exposed to the laser light reflected by the polygon mirror; a motor configured to rotate the polygon mirror; and a controller configured to sense a type of a sheet transported through the image formation apparatus. The image formation apparatus includes as operation modes a first mode in which no sheet type is sensed and a second mode in which a sheet type is sensed. The control program causes the controller to perform different processes for control regarding rotation of the motor in the first and second modes, respectively.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image formation apparatus comprising:

a light source configured to emit laser light;

a polygon mirror configured to reflect the laser light;

a photoreceptor configured to be exposed to the laser light reflected by the polygon mirror;

a motor configured to rotate the polygon mirror; and a controller configured to sense a type of a sheet transported through the image formation apparatus, the image formation apparatus having an operation mode including a first mode in which the controller does not sense the type of the sheet, and a second mode in which the controller senses the type of the sheet, the controller performing different processes for control regarding rotation of the motor in the first and second modes, respectively.

2. The image formation apparatus according to claim 1, wherein in the first mode the controller starts rotating the motor at a predetermined time point before exposure of the photoreceptor to light is started.

3. The image formation apparatus according to claim 1, wherein the image formation apparatus is configured to receive a setting of a rotation speed of the motor, and in the first mode the controller rotates the motor at a rotation speed in accordance with the setting after exposure of the photoreceptor to light is started.

4. The image formation apparatus according to claim 1, wherein in the second mode the controller does not rotate the motor before a type of a sheet is sensed.

5. The image formation apparatus according to claim 1, wherein in the second mode the controller rotates the motor after a type of a sheet is sensed, the motor being rotated at a rotation speed determined based on the type of the sheet sensed.

6. The image formation apparatus according to claim 5, wherein in the second mode, in printing on a plurality of sheets, when printing on a first one of the sheets, the controller does not rotate the motor before a type of the sheet is sensed, and instead after the type of the sheet is sensed, the controller rotates the motor at a speed determined based on the type of the sheet sensed.

7. The image formation apparatus according to claim 6, wherein in the second mode, in printing on the plurality of sheets, when printing on a second one et seq. of the sheets, before starting exposure of the photoreceptor to light, the controller rotates the motor at a rotation speed determined based on the type of the first sheet sensed.

8. The image formation apparatus according to claim 1, wherein the image formation apparatus is configured to allow either the first mode or the second mode to be selected.

9. A non-transitory computer readable recording medium storing a computer readable program which is a control program for controlling an image formation apparatus comprising:

a light source configured to emit laser light;

a polygon mirror configured to reflect the laser light;

a photoreceptor configured to be exposed to the laser light reflected by the polygon mirror;

a motor configured to rotate the polygon mirror; and a controller configured to sense a type of a sheet transported through the image formation apparatus, the image formation apparatus having an operation mode including a first mode in which the controller does not sense the type of the sheet, and a second mode in which the controller senses the type of the sheet, the control program causing the controller to perform different processes for control regarding rotation of the motor in the first and second modes, respectively.

10. The non-transitory computer readable recording medium according to claim 9, wherein in the first mode the controller starts rotating the motor at a predetermined time point before exposure of the photoreceptor to light is started.

11. The non-transitory computer readable recording medium according to claim 9, wherein the image formation apparatus is configured to receive a setting of a rotation speed of the motor, and the control program causes the controller to rotate the motor in the first mode at a rotation speed in accordance with the setting after exposure of the photoreceptor to light is started.

12. The non-transitory computer readable recording medium according to claim 9, wherein the control program does not cause the controller to rotate the motor in the second mode before a type of a sheet is sensed.

13. The non-transitory computer readable recording medium according to claim 9, wherein the control program causes the controller to rotate the motor in the second mode after a type of a sheet is sensed, the motor being rotated at a rotation speed determined based on the type of the sheet sensed.

14. The non-transitory computer readable recording medium according to claim 13, wherein in the second mode, in printing on a plurality of sheets when printing on a first one of the sheets the control program does not cause the controller to rotate the motor before a type of the sheet is sensed and instead after the type of the sheet is sensed the control program causes the controller to rotate the motor at a speed determined based on the type of the sheet sensed.

15. The non-transitory computer readable recording medium according to claim 14, wherein in the second mode, in printing on the plurality of sheets when printing on a second one et seq. of the sheets, before starting exposure of the photoreceptor to light the control program causes the controller to rotate the motor at a rotation speed determined based on the type of the first sheet sensed.

16. The non-transitory computer readable recording medium according to claim 9, wherein the image formation apparatus is configured to allow either the first mode or the second mode to be selected.

* * * * *